United States Patent [19]

Wittmer

[11] 4,184,356

[45] Jan. 22, 1980

[54] TOOL FOR STRAIGHTENING PLUMBER'S SNAKES

[76] Inventor: Steven L. Wittmer, 35564 Purcell Pl., Fremont, Calif. 94536

[21] Appl. No.: 966,795

[22] Filed: Dec. 6, 1978

[51] Int. Cl.[2] ..... B21D 3/00

[52] U.S. Cl. ..... 72/389; 72/458

[58] Field of Search ..... 72/389, 387, 380, 458, 72/457, 384

[56] References Cited

U.S. PATENT DOCUMENTS

| | | | |
|---|---|---|---|
| 677,284 | 6/1901 | Sheahan | 72/389 |
| 784,725 | 3/1905 | Yates | 72/389 |
| 2,407,040 | 9/1946 | Taramaschi | 72/389 |
| 3,531,972 | 10/1970 | Smith | 72/389 |

*Primary Examiner*—Francis S. Husar
*Assistant Examiner*—Gene P. Crosby
*Attorney, Agent, or Firm*—Linval B. Castle

[57] ABSTRACT

A tool for straightening kinks and bends in plumber's snakes in which a pivoted straightening bar journalled to a shaft is manually forced down between a pair of spaced V-blocks supporting the bent snake. The V-block spacing can be adjusted to accommodate various diameter snakes and a pair of identical compression springs on the shaft upon which the straightening bar is pivoted maintains the bar midway between the spaced V-blocks irrespective of their spacing.

4 Claims, 4 Drawing Figures

TOOL FOR STRAIGHTENING PLUMBER'S SNAKES

BRIEF SUMMARY OF THE INVENTION

This invention relates to specialized hand tools and particularly to a novel tool particularly adapted for straightening the kinks from plumbers' snakes.

A plumber's snake is a long thin flexible wire having a spiral hook, or cutting blade, on one end and which is used to remove roots or other obstructions from pipes. In use, the hooked end of the snake is inserted in the pipe to the point of the obstruction and is then rotated so that the hook will engage the obstruction so that it may be withdrawn. However, most pipes to be thus cleared may have several elbows or may have rough interior surfaces that will block the passage of the snake. Therefore, the normal practice is to "screw" the snake through the pipe either by hand rotation or by a motor drive. Unfortunately it is very common for the rotating end hook to become caught on some protrusion in the pipe or to fail to ease into a sharp bend. When this occurs, the snake will become kinked and when removed from the pipe, there may be several kink-produced bends in the snake that must be removed prior to subsequent use.

Removing a kink from a plumber's snake merely involves bending the snake back into its original straight condition. This is a simple task that an occasional snake user may accomplish by hand on small diameter snakes. However, continual users such as large plumbing contractors or tool rental agencies that may use long heavy-duty motor-driven snakes as well as smaller diameter light duty snakes, may be required to spend several hours a day in hand-straightening kinked plumbers' snakes. The present invention greatly facilitates the removal of snake kinks and enables them to be straightened in approximately one-quarter the time required by hand-straightening.

Briefly described, the invention includes a pair of spaced coplanar angle iron sections positioned to form a "V" for supporting a section of plumber's snake with a kink-produced bend placed substantially midway between the V-sections and protruding upward. The V-sections are rigidly mounted to the top of supporting channels, each of which also support a shaft block into which is journalled a shaft that is parallel with the coplanar V-sections. One end of a plumber's snake straightening bar is loosely connected to the shaft midway between its shaft blocks and, to straighten a snake in the V-sections, the straightening bar is manually forced downward on top of the center of the bend.

Small diameter kinks encountered in light duty snakes require that the V-sections be relatively close together, and large diameter bends of the larger snakes require wider spacing of the V-sections. A feature of the invention is that the separation between the V-sections are variable by adjustment of one of the supporting channels, and a pair of substantially identical spiral compression springs on the shaft between the straightening bar and each of the shaft blocks assures that the straightening bar is always positioned midway between the V-sections.

DESCRIPTION OF THE DRAWINGS

In the drawings which illustrate a preferred embodiment of the invention.

DETAILED DESCRIPTION

Figure 1:
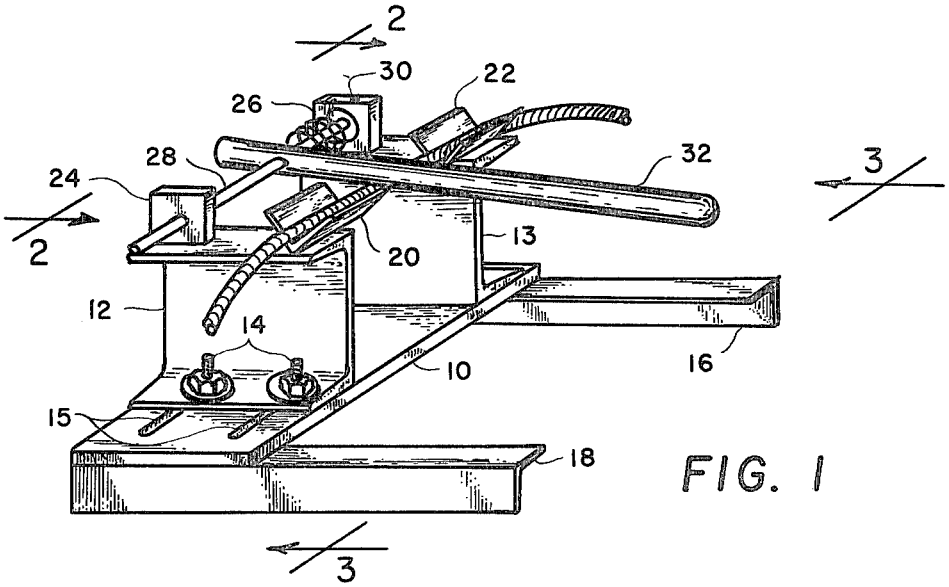
FIG. 1 is a perspective drawing illustrating the plumber's snake straightening tool of the invention.
Figure 2:
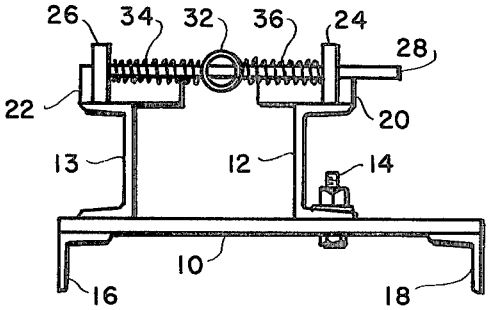
FIG. 2 is an elevation view of the rear of the tool taken along the lines 2—2 of FIG. 1.
Figure 3:
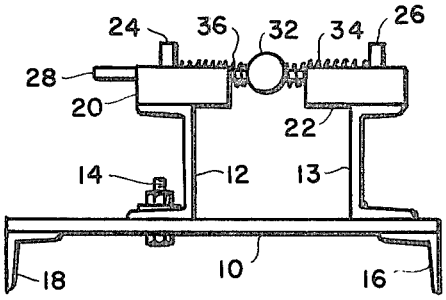
FIG. 3 is a front elevation view of the tool taken along the lines 3—3 of FIG. 1 and illustrates a close positioning of the V-sections.
Figure 4:
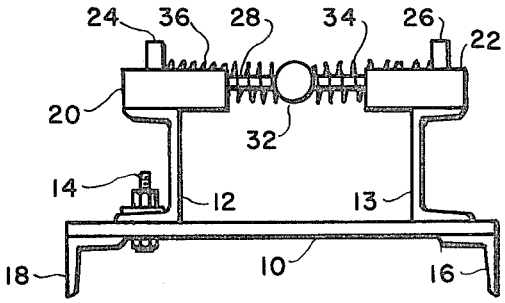
FIG. 4 is a front elevation view illustrating widely separated V-sections and the mid-positioning of the straightening bar.

As illustrated in the perspective drawing of FIG. 1, the plumber's snake straightening tool includes a base plate 10 which supports a pair of channel members 12 and 13 that are mounted on one of their two opposing side walls so that the channel exterior bases are facing one another. One of the channel members, such as channel 13, is rigidly connected to the base plate 10 such as by welding. The second channel member 12 is connected to the base plate 10 by adjustment bolts 14 which extend through holes in the channel side wall and into elongated slots 15 in the base plate 10. Therefore, by loosening the nuts on the adjustment bolts 14, the channel member 12 may be moved toward or away from the channel member 13. The base plate 10 is preferably rigidly mounted to a pair of angle members 16 and 18 in order to provide a clearance for the heads of the adjustment bolts 14 that extend below the lower surface of the base plate 10 as best illustrated in FIGS. 2 through 4. Angle members 16 and 18 may be placed on any suitable work surface or, if desired, vertical legs (not shown) may be welded or bolted to the angle members to provide a separate self-standing tool.

Rigidly mounted on the top surface of each channel member 12 and 13, opposite the base plate 10, is a V-section 20 and 22, respectively, preferably made of 3" or 4" length of ¾" angle iron. V-sections 20 and 22 are preferably welded to one end of the exterior side walls of channels 12 and 13, respectively, and on the end which will hereafter be referred to as the front of the tool. V-sections 20 and 22 are welded at an angle of substantially 45° with respect to the exterior channel side walls and the V-sections are coplanar so that the apex of the V-sections are substantially colinear and aligned with each other. The spacing between V-sections 20 and 22 should be approximately 2½" to 3" when their supporting channel members 12 and 13 are adjusted to their closest position. The slots 15 in the base plate 10 should be approximately 2" to 3" in length so that when the supporting channel member 12 is in its extended or remote position, the spacing between the V-sections 20 and 22 is approximately 5". This variation in spacing between the V-sections is necessary for straightening both small diameter kinks encountered in light duty plumbers' snakes and large diameter kinks of the heavy duty snakes, as has been previously discussed.

Mounted to the top rear of the external side wall of the supporting channel members 12 and 13 are a pair of shaft blocks 24 and 26, respectively. The shaft blocks 24 and 26 may be approximately ⅜" in thickness and approximately 1" square with a centrally located hole sufficiently large to permit a loose fit of a ⅜" diameter shaft. Shaft blocks 24 and 26 are welded to the channel members 12 and 13, respectively, with the ⅜" shaft holes coaxially positioned to receive a straight ⅜" diameter shaft 28 which is locked into the shaft block 26 by a set screw 30 and which is loosely journalled within the hole of the shaft block 24. The shaft 28 must be sufficiently long so that it remains within the shaft block 24 when the supporting channel member 12 is in its extended position.

A plumber's snake straightening bar 32, which may be a ¾" or 1" diameter pipe, 1½ feet to 2 feet in length, is radially drilled near one end to loosely receive the shaft 28 and the straightening bar 32 is thus positioned on the shaft 28 between the shaft blocks 24 and 26. The shaft 28 is preferably located approximately 2" from the colinear apex of the V-sections 20 and 22 and therefore provides great leverage for straightening the bends from plumbers' snakes positioned in the V-sections 20 and 22. It is important that the straightening bar 32 be maintained in a position midway between the V-sections 20 and 22. These sections are adjusted close to each other to accommodate light-weight plumbers' snakes or are separated for heavy-duty straightening. To assure that the straightening bar 32 maintains its mid-position regardless of the adjustment between V-sections 20 and 22, a pair of substantially identical spiral compression springs 34 and 36 are threaded on the shaft 28 and on each side of the straightening bar 32, as best illustrated in FIGS. 2, 3 and 4.

FIG. 2 is a rear elevation view of the tool taken along the lines 2—2 of FIG. 1 and illustrate springs 34 and 36 positioned on each side of the bar 32 and between shaft blocks 26 and 24, respectively. Since the force exerted by springs 34 and 36 is substantially equal, the straightening bar 32 will remain substantially midway between the shaft blocks 24 and 26 and therefore midway between the V-sections 20 and 22.

FIG. 3 is a front elevation view of the tool taken along the lines 3—3 of FIG. 1 and shows the mid-position of the straightening bar 32 when the supporting channel members 12 and 13 are in their closest position. In such a position, the springs 34 and 36 are equally compressed to assure a mid-positioning of the straightening bar 32 between the V-sections 20 and 22.

FIG. 4 is a front elevation view similar to that of FIG. 3 but shows the channel members 12 and 13 in their maximum spaced position. Springs 34 and 36 are now nearly expanded but are still compressed to maintain the position of the straightening bar 32 midway between the spaced V-sections 20 and 22.

I claim:

1. A manually operated tool for straightening bends in plumbers' snakes, said tool comprising:

a pair of spaced coplanar V-section members for receiving a plumber's snake;

a straightening bar, the first end of said bar being pivotally mounted on a shaft behind said V-section members and parallel thereto, the second end of said bar providing a handle forward of said V-section members for manually urging said bar downward between said V-section members;

adjusting means for varying the spacing between said coplanar V-section members; and centering means for maintaining said straightening bar midway between said V-section members irrespective of their spacing.

2. The tool claimed in claim 1 wherein said V-section members are attached to first and second supporting members, said first supporting member being rigidly attached to a base member, said second supporting member being adjustably attached to said base member by said adjusting means.

3. The tool claimed in claim 2 wherein said adjusting means includes at least one slot in said base member, said slot being parallel with the colinear apex of said V-section members and engaging bolt means extending through said base member and said second supporting member.

4. The tool claimed in claim 2 wherein said shaft is supported in first and second shaft blocks respectively attached to said first and second supporting members, and wherein said centering means comprises a pair of substantially identical spiral compression springs on said shaft and positioned on each side of said straightening bar between said bar and said first and second shaft blocks.

* * * * *